US012473924B1

(12) United States Patent
Botkin et al.

(10) Patent No.: US 12,473,924 B1
(45) Date of Patent: Nov. 18, 2025

(54) CEILING FAN MOUNTING ASSEMBLY

(71) Applicant: Hunter Fan Company, Memphis, TN (US)

(72) Inventors: Charles William Botkin, Cordova, TN (US); Rickey Thomas Jones, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 19/208,528

(22) Filed: May 14, 2025

Related U.S. Application Data

(63) Continuation of application No. 18/887,888, filed on Sep. 17, 2024, now Pat. No. 12,331,750.

(51) Int. Cl.
*F04D 25/08* (2006.01)
*F04D 29/60* (2006.01)

(52) U.S. Cl.
CPC ..... *F04D 25/088* (2013.01); *F04D 29/601* (2013.01)

(58) Field of Classification Search
CPC ..... F04D 25/088; F21V 33/0096
See application file for complete search history.

(56) References Cited

U.S. PATENT DOCUMENTS

| | | | | |
|---|---|---|---|---|
| 4,697,777 | A | 10/1987 | Yang | |
| 6,520,468 | B2 * | 2/2003 | Lee | F04D 29/601 248/343 |
| 8,336,844 | B2 | 12/2012 | Pearce | |
| 10,851,939 | B2 * | 12/2020 | Trout | F04D 29/668 |
| 11,118,730 | B1 | 9/2021 | Davidenko | |
| 2008/0181783 | A1 | 7/2008 | Pearce | |
| 2023/0025995 | A1 | 1/2023 | Botkin | |

* cited by examiner

*Primary Examiner* — Brian O Peters
(74) *Attorney, Agent, or Firm* — McGarry Bair PC

(57) ABSTRACT

A ceiling fan assembly can include a motor for rotating one or more blades to drive a volume of air about a space. The ceiling fan assembly can include a ceiling fan mount with a canopy. The canopy can be received by a mounting bracket to enclose the mounting hardware near the ceiling.

18 Claims, 10 Drawing Sheets

CEILING FAN MOUNTING ASSEMBLY

CROSS-REFERENCE TO RELATED APPLICATION

This application is a continuation of U.S. patent application Ser. No. 18/887,888, Sep. 17, 2024, now allowed, of which is hereby incorporated herein by reference in its entirety BACKGROUND Ceiling fans are typically suspended from a structure, such as a ceiling or wall, for moving a volume of air about a space. The ceiling fan typically includes a motor, with a rotor and stator, downrod, canopy and blades, all secured to the structure by a mounting assembly that includes fasteners and brackets. The structure to which the ceiling fan is mounted is typically a ceiling where a canopy decoratively covers the mounting assembly.

BRIEF DESCRIPTION

In one aspect, the disclosure relates A ceiling fan assembly comprising: a motor assembly comprising a rotor assembly and a stator assembly; a downrod having a first and a second end, which is coupled to the motor assembly; a ball mounted to the first end of the downrod; a surface bracket having depending spaced arms supporting a ball seat in which the ball is received; and at least one retainer clip carried by the arm and located above the ball seat, wherein when the ball is seated in the ball seat, the retainer clip overlies at least a portion of the ball to retard the upward movement of the ball.

DETAILED DESCRIPTION

Figure 1:
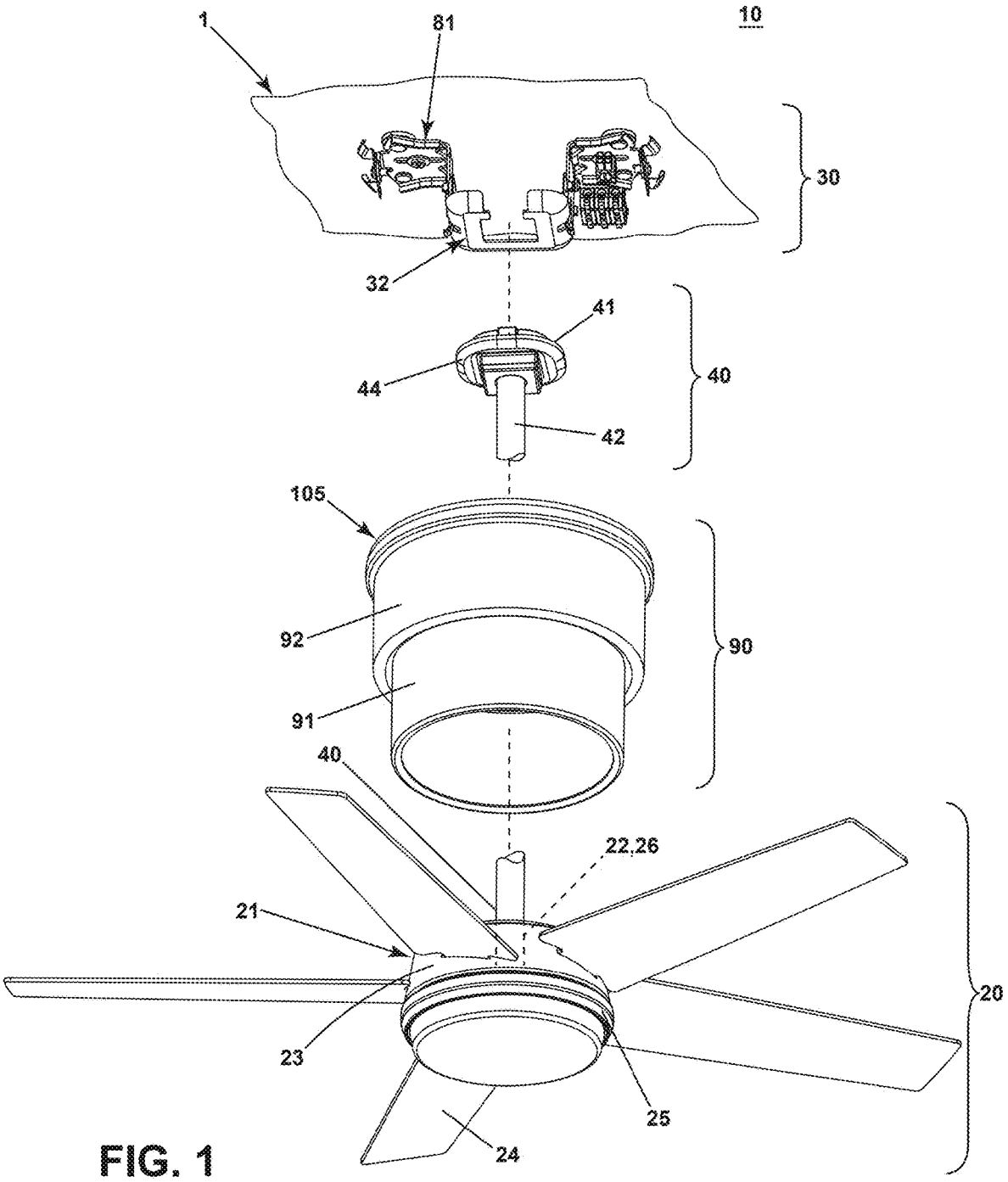
FIG. 1 is a bottom, perspective, partially exploded view of a ceiling fan assembly with a fan, surface bracket, ball, downrod and expandable canopy.

This disclosure is related to a ceiling fan mounting system, which can be used, for example, in residential, agricultural, industrial, and commercial applications. More specifically, this disclosure relates to a ceiling fan mounting system utilizing a snap-in or locking hanger ball to retard the accidental unseating or removal of the hanger ball with the hanger bracket in general, and, more specifically when the fan blades are installed or the light kit is installed, some installers may lift or move the fan, which can lead to an unseating of the hanger ball. The snap-in hanger ball retards or prevents the partial or complete unseating of the hanger ball from the hanger bracket thereby ensuring the fan will be properly coupled to the ceiling after installation.

Additionally, the snap-in or locking hanger ball is used in combination with a snap-in canopy, which simplifies the fan mounting process since the hanger ball can be snapped in place for security and then the canopy is easily slid up the downrod and snapped in place. Yet further simplifying the assembly process, especially for a low-profile mount, the canopy is an expandable/collapsable canopy, which provides for a low-profile mounting (i.e. the downrod is not materially visible) with the ease of expanding the canopy. The snap-in hanger ball enhances the expandable/collapsible canopy by ensuring the hanger ball is secured and the expansion of the canopy will not accidentally unseat the hanger ball from the hanger bracket.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring to FIG. 1, a ceiling fan assembly 10 comprises a ceiling fan 20, surface bracket 30, downrod 40, and canopy 90. The ceiling fan 20 is secured to a surface 1 (ceiling, wall, post or other support structure) by the downrod 40 and the surface bracket 30 (sometimes referred to as a ceiling bracket). The surface bracket 30 is secured to the surface 1 in any desirable manner and the downrod 40 couples the ceiling fan 20 to the surface bracket 30. The canopy 90 covers most if not all of the surface bracket 30 and at least a portion of the interface of the surface bracket 30 and downrod 40. The canopy 90 can function as one or both of an aesthetic covering for the mechanical and electrical connections for the surface bracket 30 and the surface 1.

The ceiling fan 20 can comprise a motor 21 having a motor shaft 22, a rotor 23, and a stator 25. The motor shaft 22 is typically stationary and can be secured to or integrated with the stator 25. The rotor 23 is rotationally coupled to the stationary motor shaft 22 by a bearing assembly (not shown) supported on the motor shaft 22. The ceiling fan 20 further includes a plurality of blades 24, which are directly coupled to the rotor 23 or indirectly coupled through a bracket, with a common form of the bracket being what is referred to as a blade iron. The ceiling fan can still further include a motor adapter 26 that couples the motor shaft 22 to the downrod 40.

The downrod 40 comprises a ball 41 affixed to one end of a downrod tube 42. The downrod 40 can be of a fixed or adjustable length, such as a telescoping tube. The end of the downrod 40 opposite the ball 41 is secured to the motor shaft 22 and/or the motor adapter 26. The ball 41 is often referred to as a hanger ball since the ball 41 hangs from the surface bracket 1. In an alternative mounting, the ball 41 could be mounted directly to the motor shaft, which would eliminate the need for the downrod tube 42 and motor adapter 26. In the context of FIG. 1, what is shown as the downrod tube 42 would be the motor shaft. In such an alternative, the length of the motor shaft can be selected as needed.

Figure 2:
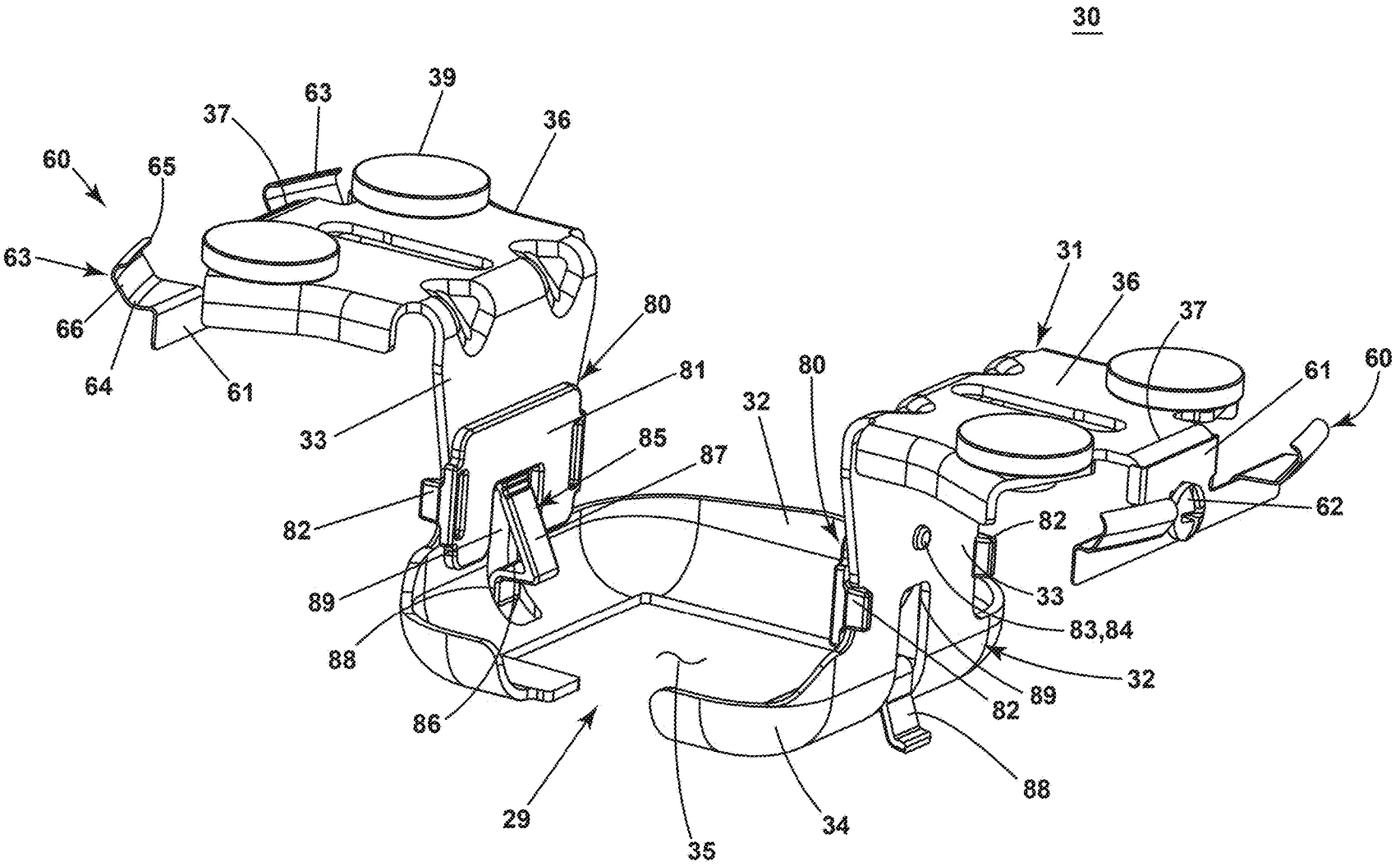
FIG. 2 is a perspective view of the hanger bracket of FIG. 1.

Referring to FIG. 2, the surface bracket 30 has surface plate 31 from which is suspended a ball seat 32 by spaced arms 33 extending between the surface plate 31 and the ball seat 32. The ball seat 32 includes an open collar 34, defining a ball opening 35 and a downrod slot 29, which is oriented with the spaced arms 33 to define an inlet through which the tube 42 can pass. As illustrated, the opening 35 is advantageously shaped to conform with the shape of at least a portion of the ball 41, such that a portion of the ball 41 is received within the opening 35 and functions as part of an anti-rotation structure thereby preventing relative rotational movement of the ball 41 and seat 32. A suitable shaped opening includes anything that is polygonal, such as the illustrated square. The opening 35 need not be shaped for anti-rotation. The downrod slot 29 is shaped to permit the passing of the tube 42. In this way, the ball 41 can be assembled to the tube 42 before the downrod passes through the downrod slot 29 or the opening 35.

As illustrated the surface plate 31 and ball seat 32 are integrally formed as a monolithic piece. However, the surface plate 31 can be a separate element, which may be referred to as a ceiling plate. Similarly, the ball seat 32 and arms 33 may be formed as a separate piece, which may be referred to as a hanger bracket, that is connected to the surface plate 31. For purposes of this disclosure, the surface plate 31 and seat 32 may be integrally formed as shown or may be physically separate. Whether they are formed as a monolithic structure or as separate pieces, the terms surface plate, surface bracket, ceiling bracket, ceiling plate, and hanger bracket are still applicable.

The surface plate 31 has a plurality of openings for receiving fasteners, such as screws or bolts, to secure the surface plate 31 to the structure 1 or an electrical fixture, such as a junction box, with the structure 1. The surface plate 31 is illustrated as having wings 36 extending from the arms 33 but could be a continuous plate, which may or may not be flat. The wings define a flange 37, which is illustrated as multiple discrete flanges 37, but it could be a continuous flange 37.

Each of the wings 36 has a flange 37 that extends away from the wings 36. While the wings 36 are illustrated as two, diametrically opposed wings 36, there could be more than two spaced about the periphery of the surface bracket 30.

Resilient bushings 39 can be affixed to the wings 36 and are sized to bear against the structure 1 when the surface bracket 30 is secured to the structure 1. The bushings 39 function to stabilize the surface bracket against the surface and can conform to the structure 1.

A set of snap springs 60 are mounted to the flanges 37. It is contemplated there will be one snap spring 60 for each flange 37 but it is possible to mount more than one snap spring 60 to each flange 37. The snap spring 60 comprises a base 61, which is secured to the flange 37, by a suitable fastener, such as a screw or bolt 62 passing through the base 61 and into a tapped opening in the flange 37, which increases the ease of assembly.

One or more locating feet 63 extend from the base 61. The locating feet include a first segment 64, second segment 65, and a reverse turn 66. The first segment 64 extends away from the flange 37 while the second segment 65 extends toward the flange 37 because of the reverse turn 66. While the first and second segments 64, 65 are shown extending upwardly, in addition to either toward or away from the base, the snap spring 60 could be designed such that the first and second segments 64, 65 extend downwardly.

It is contemplated that the snap spring 60 will be formed from a single piece of resilient material, such as a thin plate of metal, like spring steel, which is cut and then bent into the configuration as seen in the drawings. However, it is possible form the snap spring 60 in other ways, such as injection molding from plastic, or 3-D printing from plastic or metal, or stamped as a metal part.

While the surface plate 31 is shown in a two-wing configuration, it is contemplated the that the surface plate 31 could be a continuous structure, such as, for example, a disk or plate. In a disk or plate configuration, the flange 37 could be continuous about the periphery of the disk or plate, with the snap springs 60 mounted at different peripheral locations along the flange 37. The shape of the disk or plate could be circular or some other desired shape. The disk or plate need not be flat.

Retainers, illustrated as retainer clips 80 are affixed to the arms 33 and secure the ball 41 within the seat 32. In securing the ball 41 within the seat 32, the retainers retard or prevent the accidental removal of the ball 41 from the seat 32, especially by an accidental upward force acting on the fan 20, such as during installation.

The retainer clips 80 have a body 81 from which extend attachment fingers 82 in combination with an alignment pin 83, which corresponds to an alignment holes 84 in the arms 33. To secure the retainer clips 80 to the arms 33, the body 81 is oriented relative to the arms 33 such that the pin 83 is received within the holes 84 and the attachment fingers 82 are snapped over the edges of the arms 33. The attachment fingers 82 are resilient and spring over the edges of the arms 33. The attachment fingers 82 could, alternatively, be a structure, resilient or not, that is snapped into a corresponding hole/opening in the arms 33.

The retainer clips 80 further include catches 85 or stops that are in the form of a shaped or bent element extending from the body 81. The catches 85 will overlie the ball 41 once it is seated in the seat 32 and retard or prevent the upward movement of the ball 41 from the seat 32.

As illustrated, the catches 85 form a catch face 86 in the form of a flat facing the seat 32. The catch face 86 will confront a portion of the ball 41 when it is seated in the seat 32. The catches 85 further include a deflection surface 87, in the form of a ramp, which happens to connect the catch face 86 to the body 81. A release in the form of a release finger 88 extends from the catch face 86. The catch face 86, deflection surface 87, and release finger 88 overlie or extend through a complementary slot 89 in the arms 33. While the release is illustrated as a release finger, other structures than a finger are possible.

As illustrated a strip of material, preferably resilient or deflectable material, extending from the body 81, forms the catch face 86, deflection surface 87, and release finger 88. As shown, the strip of material is continuous making it possible to form the entire retainer clip of the same material, such as stamped metal. The slot 89 enables the movement of the strip of material into the slot 89 and out of the way of the ball 41 as it is being seated. The release fingers 88 are accessible from the exterior of the surface bracket 30. While the retainer is shown as a separate piece that is clipped or snapped onto the arms 33, the retainer could be integrally formed by a cut out from the arm 33 when forming the slot 89.

Figure 3:
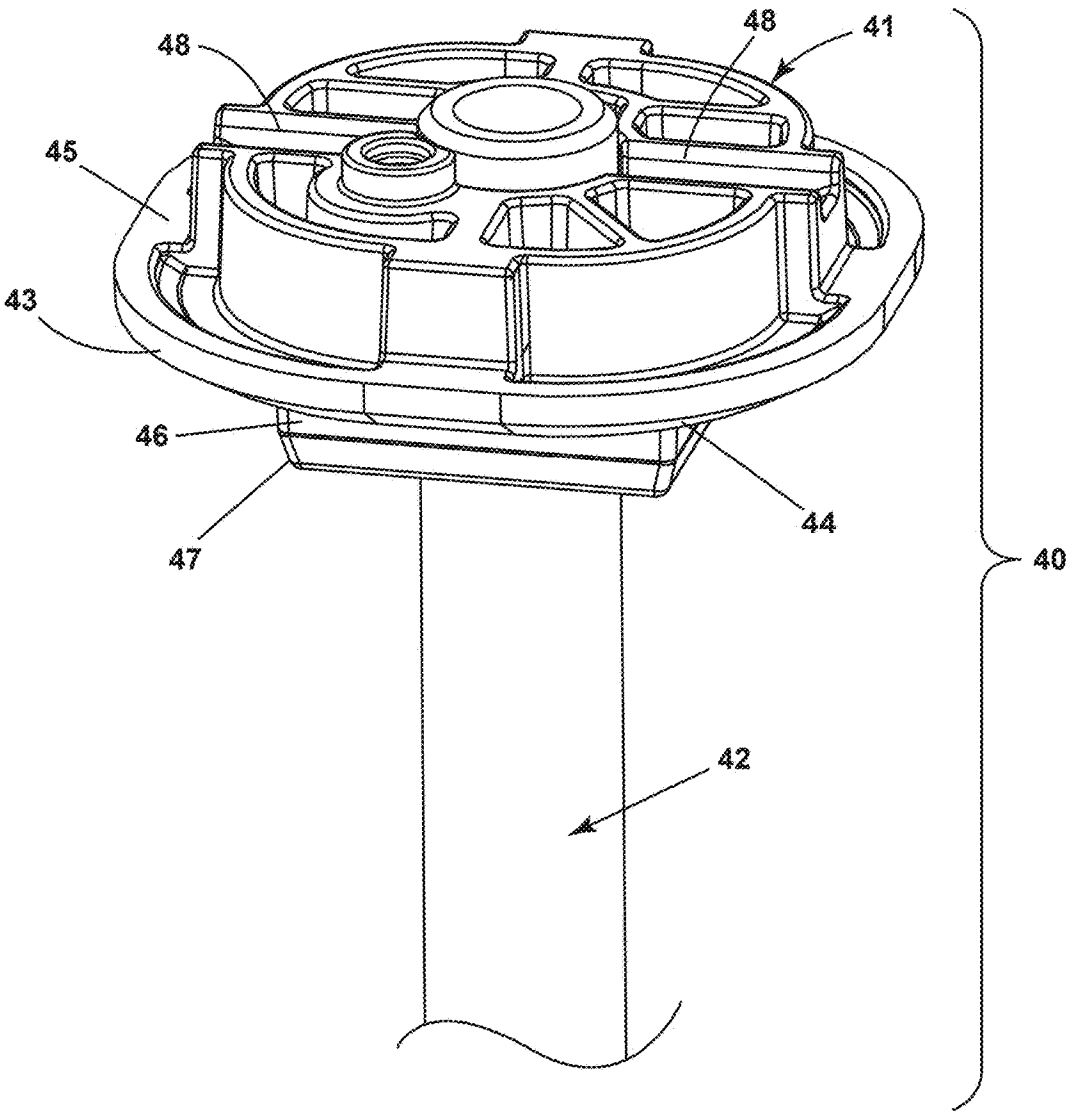
FIG. 3 is a perspective view of the hanger ball of FIG. 1.

FIG. 3 illustrates the ball 41 in greater detail. The ball 41 is not rounded in the traditional sense of a ball. Instead, the ball 41 comprises a shoulder 43, which is illustrated as a square with rounded corners or also known as a squircle, when viewed in planform or looking down the axis of the downrod 40, yet still has a rounded or partially hemispherical portion 44 that terminates in peripheral flat 45, which forms the upper portion of the ball 41. An anti-rotation element 46 in the form of a polygonal base extends below the rounded portion 44. The anti-rotation element 46 will typically be the same shape as the opening 35 in the collar 34. With such a configuration, the anti-rotation element 46 is received in the complementary opening 35, with the mating shapes preventing the rotation of the ball 41 relative to the collar 34. The rounded portion 44 can have the same radius of curvature as the collar 34. A taper 47 can be formed on the anti-rotation element 46 to ease its alignment and insertion into the opening 35. Opposed channels 48 are located in the upper portion of the ball 41. The channels are complementary to the catch faces 86 and receive the catch faces 86 when the ball 41 is properly seated. Thus, the channels 48 mating with the catch faces 86 function to rotationally index the ball 41 in the seat and also functions as another anti-rotation element, which can be used in combination with the anti-rotation element 47 or in place of the anti-rotation element 46.

Figure 4:
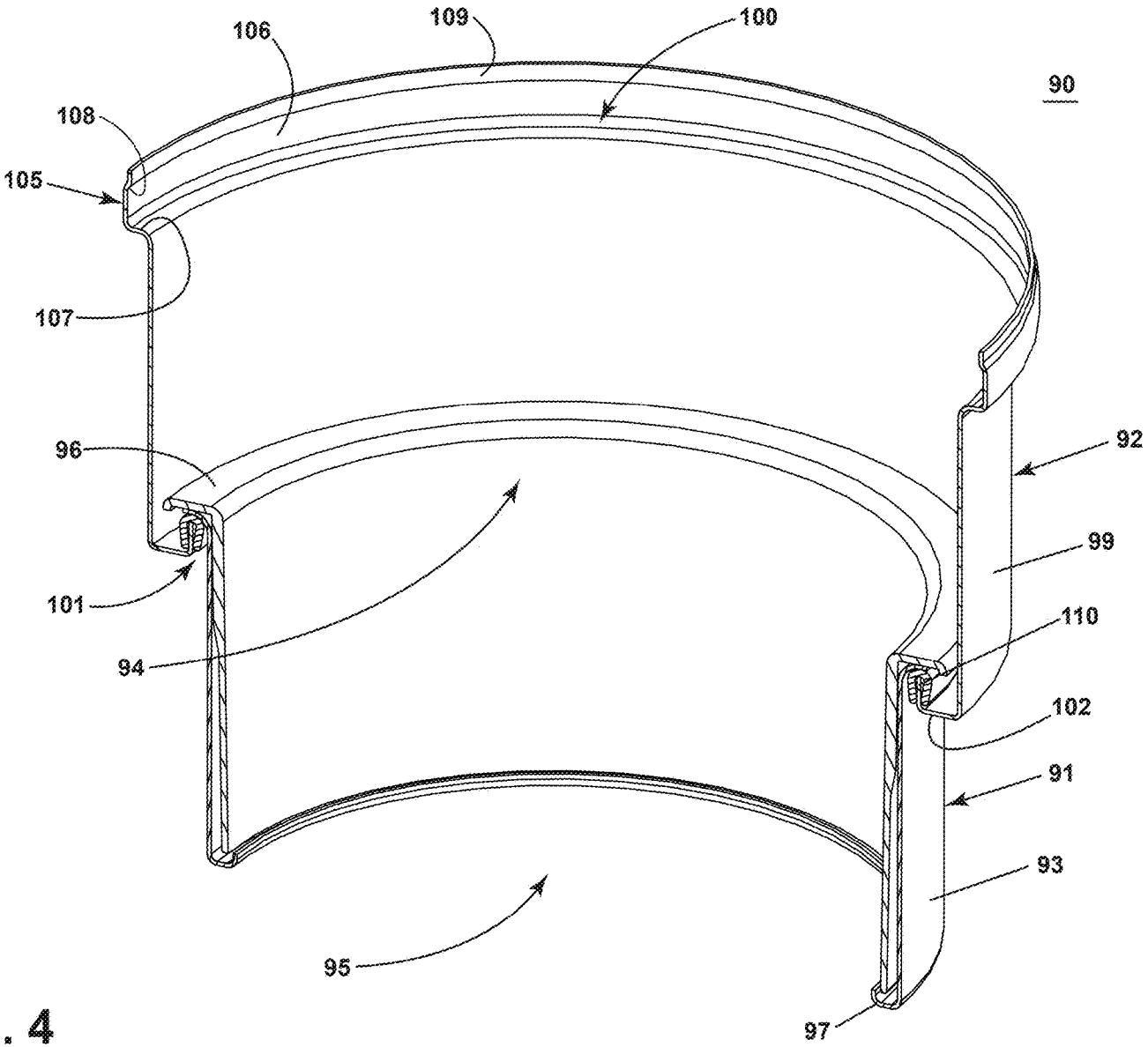
FIG. 4 is a perspective sectional view of the expandable canopy of FIG. 1.

FIG. 4 is a perspective view of the canopy 90, which is illustrated as a multi-piece expandable canopy having telescopically connected segments, which are illustrated as two segments, a lower segment 91 and an upper segment 92. The two segments 91, 92 can be relatively moved between a collapsed condition and an extended condition. However, more than two segments could be used. The lower segment 91 has a peripheral wall 93 defining a hollow interior with an open top 94 and open bottom 95. A radial flange 96 extends around the open top 94 and a bottom wall 97 defines the open bottom 95.

The upper segment 92 has a peripheral wall 99 defining an open top 100 and an open bottom 101. The open bottom 101 terminates in a radial flange 102. The open top 100 is defined by a pocket 105. The pocket 105 is sized to receive the snap springs 60. The pocket 105 can be a recess 106 in the peripheral wall 99. The recess 106 can be formed as rib 107 in the peripheral wall 99, with the inner surface of the rib 107 forming a channel that defines the recess 106. The channel has a concave cross section when seen from the interior of the canopy 90. The recess 106 includes an upper shoulder 109 and a lower shoulder 108. The recess 106 and corresponding channel are illustrated as a continuous recess about the peripheral wall 99. However, the recess 106 could be discrete recesses that are located according to the snap springs 60. The diameter of the canopy peripheral wall 99 is greater below the recess 106 than above the recess 106.

The radial flanges 96 and 102 are illustrated in overlying relationship. A noise isolating seal 110 is located between the radial flanges 96 and 102. While the noise isolating seal 110 could be mounted to either one of the radial flanges or carried by either one of the segments, it is illustrated as being carried by the upper segment 92 and adjacent the radial flange 96. When the expandable canopy 90 is expanded, the radial flanges will contact the noise isolating seal to help seal the interior of the canopy 90. The noise isolating seal 110 could also perform a fluid sealing function as well or in place of a noise isolating function.

Figure 5:
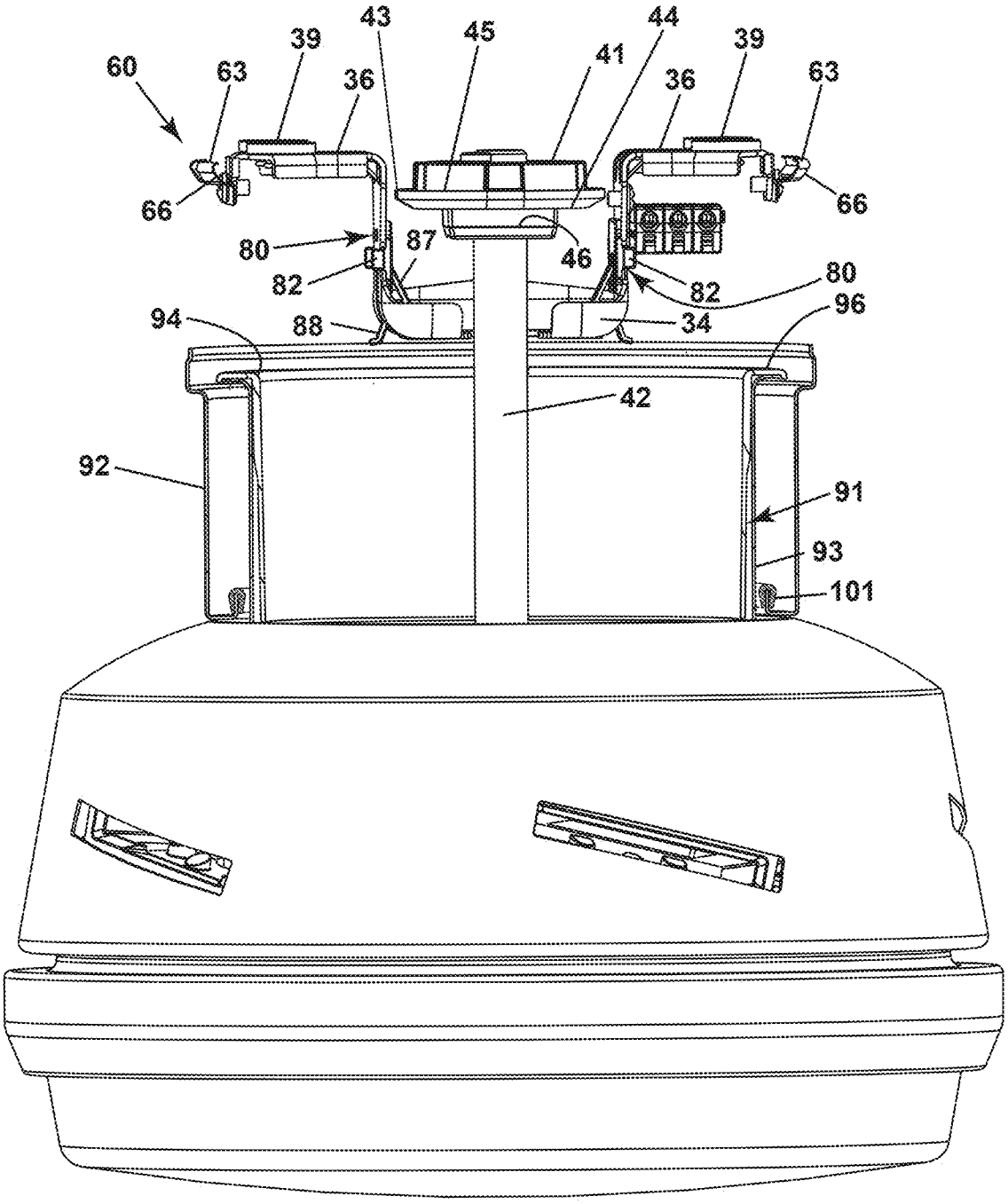
FIG. 5 is a partial sectional view of the hanger ball prior to being seated in the hanger bracket and the expandable canopy in a collapsed condition.
Figure 6:
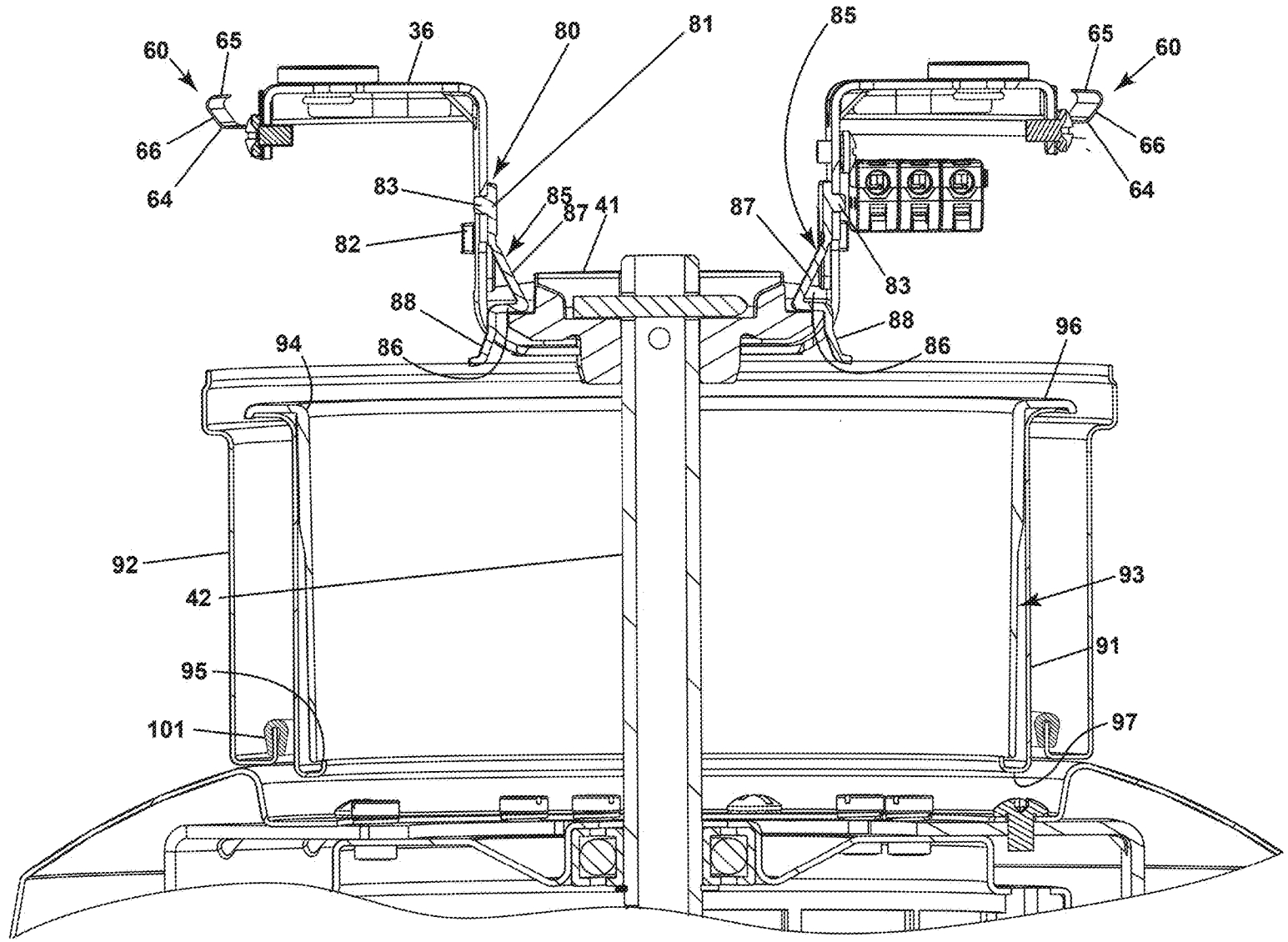
FIG. 6 is a partial sectional view of the hanger ball fully seated in the hanger bracket and the expandable canopy in a collapsed condition.
Figure 7:
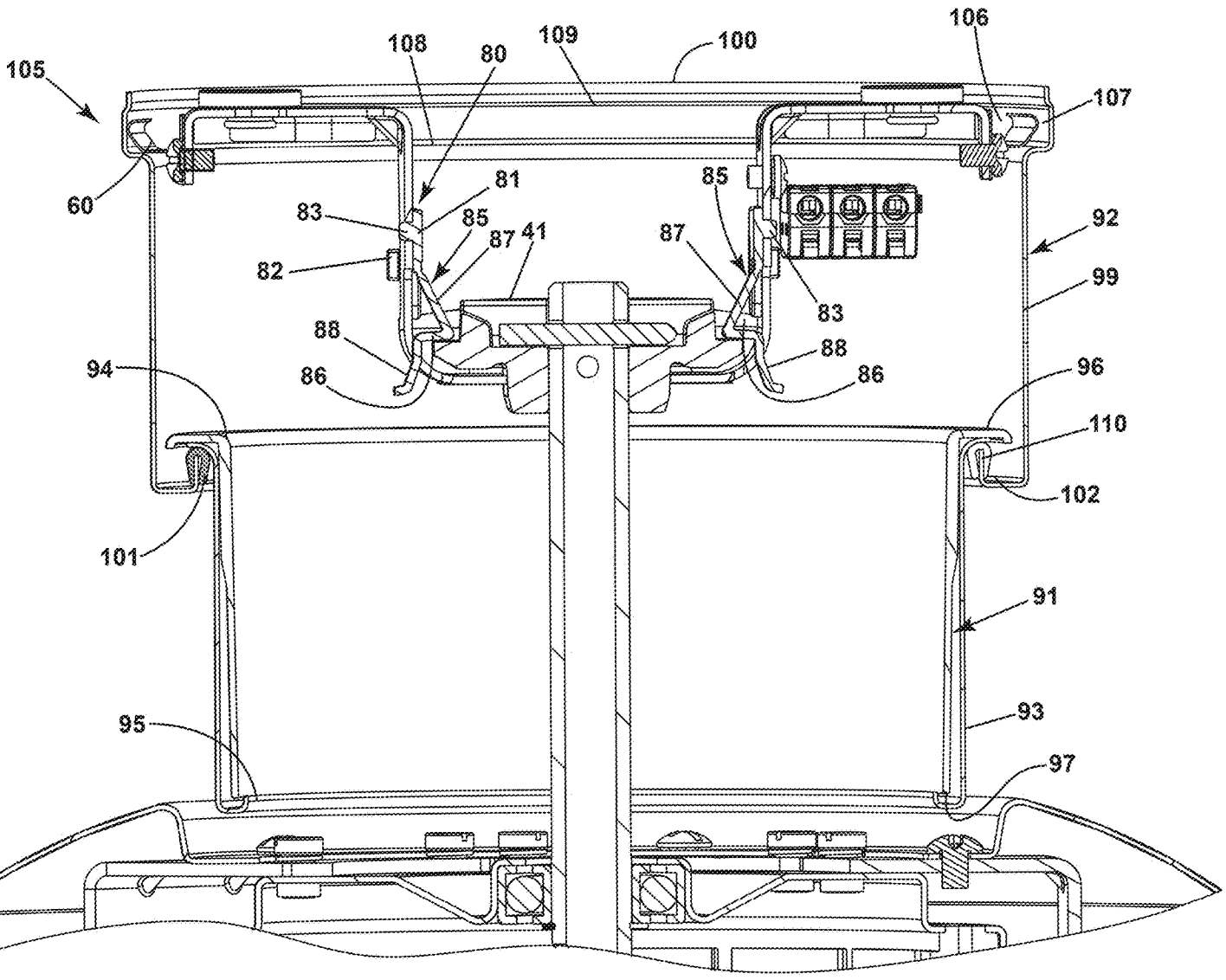
FIG. 7 is a partial sectional view of the hanger ball fully seated in the hanger bracket and the expandable canopy in an expanded condition.

FIGS. 5-7 illustrate the assembly of the ball 41 to the seat 32 to thereby secure the ceiling fan to the structure. It is assumed for purposes of this description that the ball 41 is already secured to the tube 42, which is secured to the fan 20. It is also further assumed that the surface bracket 30 is secured to the surface 1. With this starting point and referring the FIG. 5, the ceiling fan 20 is lifted and moved by the user such that the tube 42 is passed through the downrod slot 29 of the collar 34 and the ball 41 is above and in overlying relationship with the seat 32. In this position, the canopy 90 is still collapsed and is already slid over and onto the tube 42, and most likely resting on the fan 20. At this point, the lower segment 91 of the canopy can be affixed to the fan 20 or downrod 40, if desired, but not necessary.

Referring to FIG. 6, from the position shown in FIG. 5, the fan 20 is lowered such that the ball 41 is lowered toward and seated in the seat 32. As the ball 41 is lowered to being seated, the shoulder 43 first abuts the deflection surfaces 87. The continued lowering of the fan 20 causes the shoulder 43 to deflect the catches 85 out of the way via contact with the deflection surfaces 87. Once the shoulder 43 passes the catch face 86, the catches 85 are free to resilient return to their prior location where the catch face 86 will now overlie the peripheral flat 45 of the ball 41 and the rounded portion 44 resides in the collar 34 while the anti-rotation element 46 resides in the opening 35.

In this position, the anti-rotation element 46 is located withing the opening 35 of the seat 32 thereby preventing rotation of the ball 41 relative to the surface bracket 30. The catches 85 are also preventing the removal of the ball 41 from the seat 32 by the catch faces 86 overlying the shoulder 43. To remove the ball 41 from the seat 32, the catches 85 can be moved out of the way by a user grasping the release fingers 88 to move the catches 85 out of overlying relationship with the peripheral flat 45 of the shoulder 43.

It should be noted that while the anti-rotation is being described along with the securing of the ball 41 in the seat 32, these two functions are not dependent on each other. The securing of the ball 41 in the seat 32, could be accomplished with or without the anti-rotation structure and vice-versa.

From the position shown in FIG. 6, to complete the assembly, the user or installer need merely to extend the upper segment 92 of the canopy 90 from the collapsed position of FIG. 5 until the upper segment is snapped into place with the snap springs 60 as shown in FIG. 7. That is as the upper segment 92 is moved up, the continued upward movement will result in the snap springs 60 being received in the pocket 105 to fix the upper segment 92 in the extended condition. If the lower segment 91 is unattached to the fan 20 or downrod 40, it may be necessary to pull down the lower segment 91 after attaching the upper segment 92.

Figure 8:
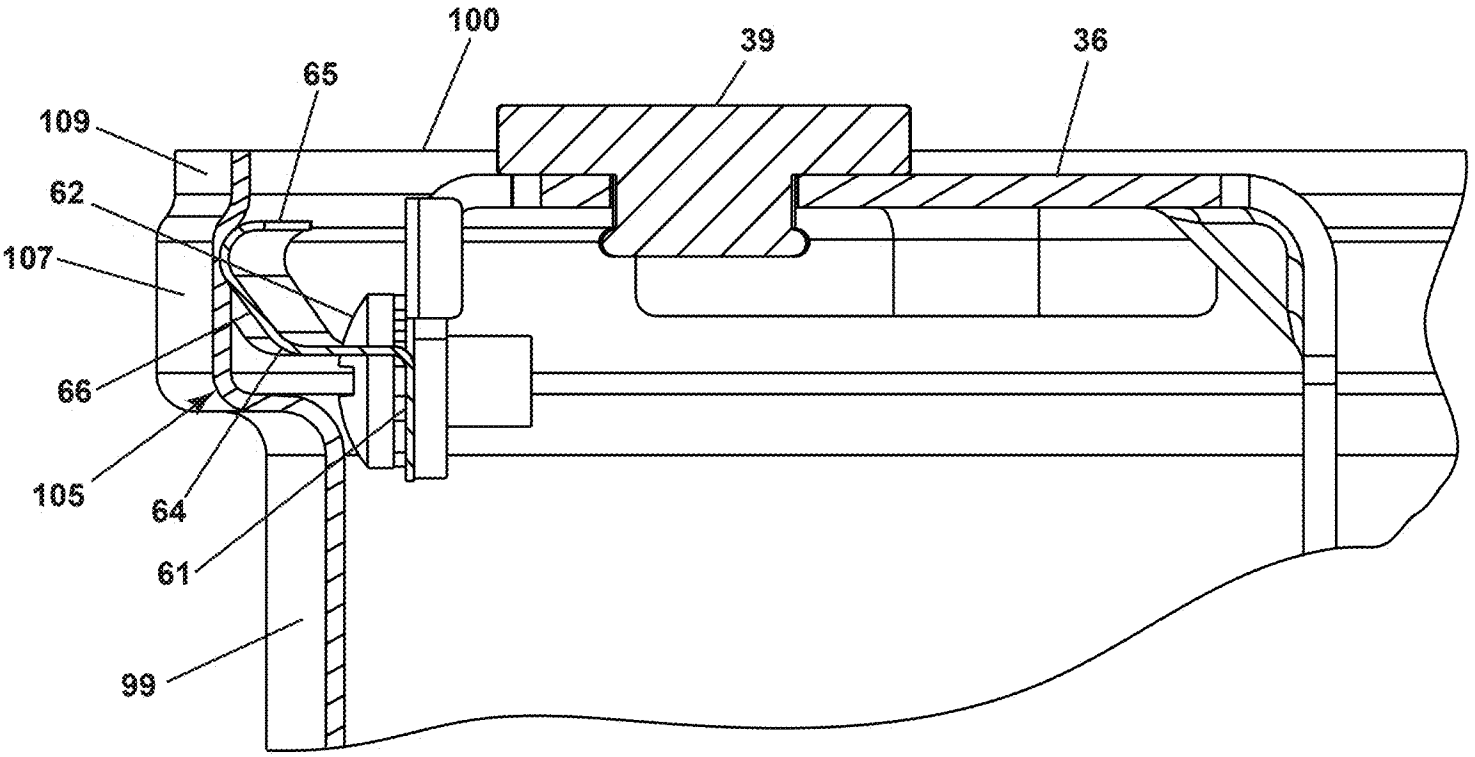
FIG. 8 is a partial section view showing the canopy secured to the surface bracket with a snap spring.

FIG. 8 shows the relationship of the snap spring 60 to the pocket 105 when the canopy 90 is affixed or snap-fitted to the surface bracket 30. As is seen, the reverse turn 66 is received within the pocket 105, with the reverse turn 66 and/or the second segment 65 bearing against the upper shoulder 59.

The recess 106 and snap spring 60 have similar or complementary cross-sectional shapes as seen in FIG. 8. The first segment 64 is longer than the second segment 65, which is similar to the shapes of the lower shoulder 108 and upper shoulder 59. Similarly, the first segment 64 is longer and at a steeper angle than the second segment 65 as is the lower shoulder 108 to the upper shoulder 59.

Figure 9:
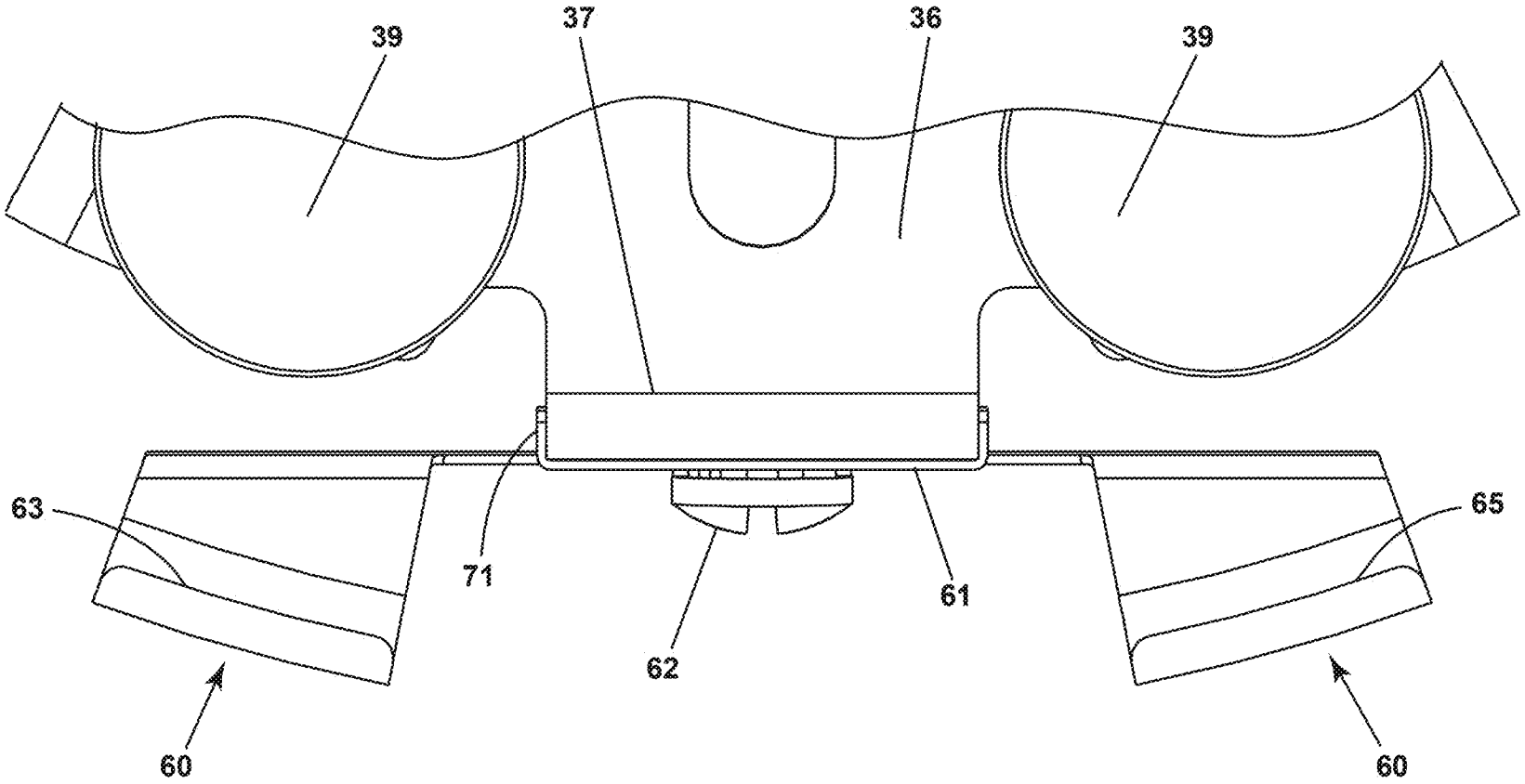
FIG. 9 is a top view of a portion of FIG. 8 and illustrates the interface between the snap spring and the surface bracket.
Figure 10:
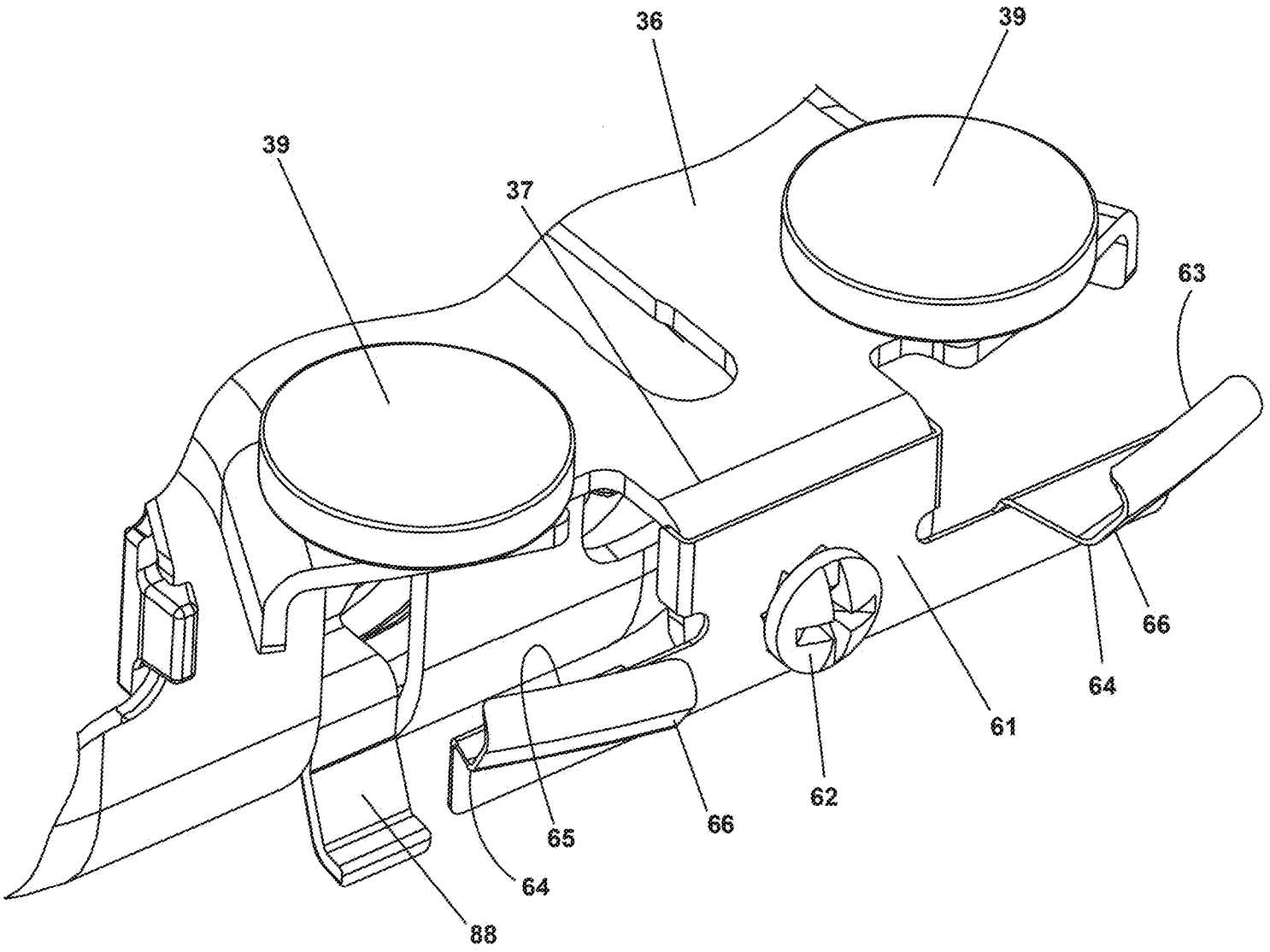
FIG. 10 is a perspective view of the area of FIG. 9.

FIGS. 9 and 10 illustrate the interface between the snap spring 60 and the flange 37. The base 61 includes tabs 71 that wrap around at least a portion of the edge of the flange 37. The tabs 71 retard clockwise rotation of the base 61 about and axis looking down the centerline of the fastener 62. The tabs 71, along with the base 61, retard rotation about a vertical axis passing through the centerline of the fastener. The tabs 71 thereby help retard the base 61 from twisting, especially when the fastener 62 is installed, which helps maintain the level of the locating feet 63 such they will more easily be received with the pocket 105.

The snap spring 60 is shaped such that the unflexed outer diameter defined by the reverse turn 66 is slightly larger than the diameter of the recess 106, which leads to the locating feet 63 being sprung and flexed when received within the recess 106, which aids in holding the canopy 90 to the surface bracket 30, since the locating feet 63 are biased into the recess 106. When the canopy is secured to the surface bracket 30, the second segment 65 will bear against and support the upper shoulder 59 to help hold the canopy in the desired position. At the same time, the reverse turn 66 is biased into the recess 106 to further aid in holding the position of the canopy.

To remove the canopy 90 from the surface bracket 30, a downward force must be applied to the canopy 90, with the magnitude of the downward force being great enough to deflect the snap spring 60 and permit the removal of the canopy 90.

To the extent not already described, the different features and structures of the various embodiments can be used in combination, or in substitution with each other as desired. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A ceiling fan assembly comprising: a motor assembly comprising a rotor assembly and a stator assembly; a downrod having a first and a second end, which is coupled to the motor assembly; a ball mounted to the first end of the downrod; a surface bracket having a ball seat in which the ball is received; and at least one retainer clip releasably securing the ball in the ball seat.

The ceiling fan assembly of any preceding clause wherein the ball seat comprises a collar on which the ball rests.

The ceiling fan assembly of any preceding clause wherein the collar defines a ball opening through which the downrod axially passes when the ball is received in the seat.

The ceiling fan assembly of any preceding clause wherein the collar further defines a downrod slot through which the downrod can be passed as the ball is moved into an overlying relationship with the collar.

The ceiling fan assembly of any preceding clause wherein the at least one retainer clip is carried by the surface bracket.

The ceiling fan assembly of any preceding clause wherein the retainer clip comprises a catch movable between a retaining position, where the ball is retained within the seat, and a release position, where the ball is removable from the seat.

The ceiling fan assembly of any preceding clause wherein the retainer clip further comprises a release coupled to the catch.

The ceiling fan assembly of any preceding clause wherein the surface bracket comprises at least one arm supporting the collar and the catch extends away from the arm and overlies the ball.

The ceiling fan assembly of any preceding clause wherein the release extends from the catch.

The ceiling fan assembly of any preceding clause wherein the catch is located on one side of the at least one arm and the release is accessible on an opposite side of the arm.

The ceiling fan assembly of any preceding clause wherein the at least one arm comprises a slot and the release comprises a release finger extends through the slot.

The ceiling fan assembly of any preceding clause wherein the catch defines a flat face that overlies the seat and the release finger extends from the flat face.

The ceiling fan assembly of any preceding clause wherein the retainer clip is mounted to the at least one arm.

The ceiling fan assembly of any preceding clause wherein the retainer clip is snap-fit to the at least one arm.

The ceiling fan assembly of any preceding clause wherein there are multiple retainer clips.

The ceiling fan assembly of any preceding clause wherein ball comprises a shoulder that abuts the collar.

The ceiling fan assembly of any preceding clause wherein the shoulder has at least one rounded corner.

The ceiling fan assembly of any preceding clause wherein the shoulder is rectangular with rounded corners.

The ceiling fan assembly of any preceding clause wherein the ball has an index that is received within a complementary opening in the collar.

The ceiling fan assembly of any preceding clause wherein the index is a geometric body and the opening is circumscribed by the collar.

For any of the preceding clauses, a method of attaching a ceiling fan motor assembly to a mounting bracket, where the motor assembly comprises a downrod with a ball and the mounting bracket comprises a surface bracket with a seat having a side opening as a bottom opening, with a collapsible canopy circumscribing the downrod, the method comprising: passing the downrod through the side opening and into the bottom opening until the ball overlies the seat and the canopy is below the surface bracket to define an overlying position; lowering the motor assembly from the overlying position until the ball rests in the seat and actuating a latch to secure the ball to the surface bracket; and expanding the collapsible canopy from a collapsed condition to an expanded condition where the canopy is snap-fit to the surface bracket.

What is claimed is:

1. A ceiling fan assembly comprising: a motor assembly comprising a rotor assembly and a stator assembly; a downrod having a first and a second end, which is coupled to the motor assembly; a ball mounted to the first end of the downrod; a surface bracket having depending spaced arms supporting a ball seat in which the ball is received; and at least two retainer clips carried by the arm and located above the ball seat, wherein when the ball is seated in the ball seat, the retainer clips overlie at least a portion of the ball to retard the upward movement of the ball.

2. The ceiling fan assembly of claim 1 wherein each of the retainer clips is carried by a different one of the spaced arms.

3. The ceiling fan assembly of claim 2 wherein spaced arms comprise two spaced arms.

4. The ceiling fan assembly of claim 1 wherein the at least two retainer clips are movable between a first position retarding the upward movement of the ball, when the ball is seated in the seat, and a second position not retarding the upward movement of the ball, when the ball is seated in the seat.

5. The ceiling fan assembly of claim 4 wherein the at least two retainer clips comprises a catch movable between a retaining position, corresponding to the first position, and a release position, corresponding to a second position.

6. The ceiling fan assembly of claim 5 wherein the at least two retainer clips further comprise a release coupled to the catch.

7. The ceiling fan assembly of claim 6 wherein the release extends from the catch.

8. The ceiling fan assembly of claim 7 wherein the catch is located on one side of one of the arms and the release is accessible on an opposite side of the arm.

9. The ceiling fan assembly of claim 8 wherein arm comprises a slot and the release comprises a release finger extends through the slot.

10. The ceiling fan assembly of claim 9 wherein the catch defines a flat face that overlies the seat and the release finger extends from the flat face.

11. The ceiling fan assembly of claim 10 wherein the retainer clips are snap-fit to the at least one arm.

12. The ceiling fan assembly of claim 11 wherein the retainer clips comprise a body from which the catch extends and attachment fingers snap-fitting to the arm.

13. The ceiling fan assembly of claim 12 wherein the catch is a resilient element formed with the body.

14. The ceiling fan assembly of claim 1 where there is a retainer clip for each arm.

15. The ceiling fan assembly of claim 1 wherein the retainer clips comprise a body that is snap-fit to one of the arms.

16. The ceiling fan assembly of claim 15 wherein the retainer clips comprise a catch that overlies the ball.

17. The ceiling fan assembly of claim 16 wherein the retainer clips further comprise a release coupled to the catch.

18. The ceiling fan assembly of claim 17 wherein the one of the arms has a slot through which the release extends.

* * * * *